United States Patent [19]

Osborne

[11] 3,952,809

[45] Apr. 27, 1976

[54] SERIES TO PARALLEL TRANSFER CIRCUIT FOR INITIATOR STRING

[75] Inventor: William B. Osborne, Marlboro, Mass.

[73] Assignee: Walter Kidde & Co., Inc., Clifton, N.J.

[22] Filed: Mar. 14, 1975

[21] Appl. No.: 558,471

[52] U.S. Cl. ..... 169/61; 169/28

[51] Int. Cl.[2] ..... A62C 37/04

[58] Field of Search ..... 169/60, 61, 23, 26, 169/28, 54; 340/418

[56] References Cited

UNITED STATES PATENTS

| | | | |
|---|---|---|---|
| 2,373,819 | 4/1945 | Eaton | 169/28 |
| 3,713,491 | 1/1973 | Grabowski et al. | 169/61 |

*Primary Examiner*—Evon C. Blunk
*Assistant Examiner*—Michael Mar
*Attorney, Agent, or Firm*—John E. Toupal

[57] ABSTRACT

A fire protection system including a plurality of suppressor units activatable to suppress a detected fire; a plurality of electrical current responsive activators, one associated with each of the suppressor units and adapted to induce activation thereof; a control circuit connecting the activators in series and including an actuator for initiating activating current flow to the activators; and an auxiliary circuit for connecting the activators parallel in response to the initiation of activating current flow by the actuator, the auxiliary circuit including a plurality of electronic switches, one connected between the supply and each of the junctions between each pair of series connected activators.

10 Claims, 1 Drawing Figure

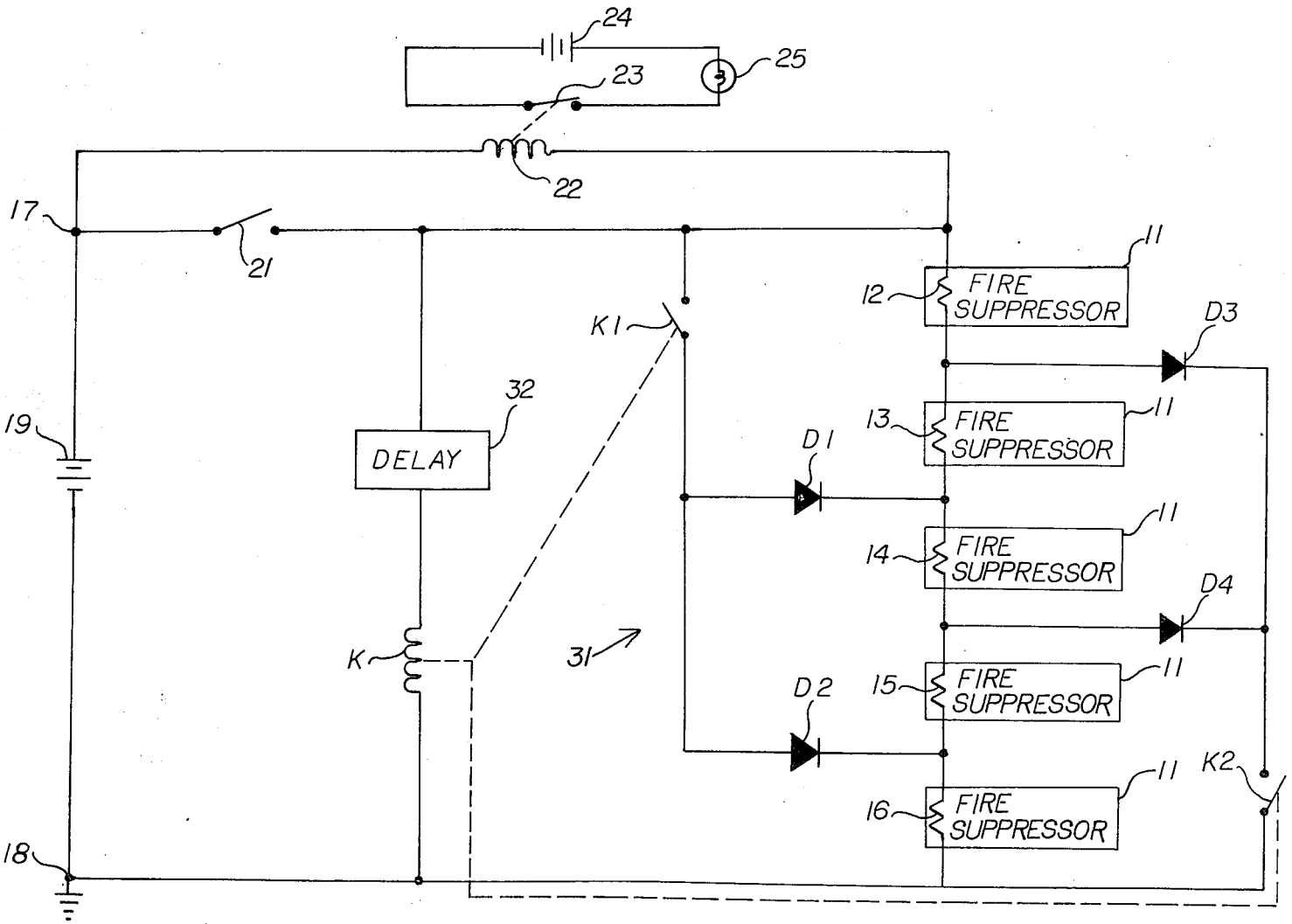
FIRE SUPPRESSOR
FIRE SUPPRESSOR
FIRE SUPPRESSOR
FIRE SUPPRESSOR
FIRE SUPPRESSOR
DELAY
D1
D2
D3
D4
K1
K2
K
11
12
13
14
15
16
17
18
19
21
22
23
24
25
31
32

SERIES TO PARALLEL TRANSFER CIRCUIT FOR INITIATOR STRING

BACKGROUND OF THE INVENTION

This invention relates generally to fire protection systems and, more particularly, to fire protection systems in which a plurality of individual fire suppressor units are simultaneously activated to extinguish a fire.

Certain fire protection systems employ a plurality of strategically located suppressor units, each including an extinguishant filled vessel and an electrically operated release mechanism for inducing discharge of the extinguishant in response to detection of a fire. When simultaneous operation of all suppressor units is desired, the system is provided typically with a control circuit that produces coincident activation of all release mechanisms. In such systems, it is common technique to electrically supervise the electric integrity of the release mechanisms by providing and monitoring a trickle current through a series connection thereof. Although this series supervision establishes a constant knowledge of release mechanism integrity, there remains the possibility that a single release member failure will cause failure of the entire series system. In addition, even a detected failure of a release mechanism can prevent system operation if the detected failure occurs coincidentally with a demand for system actuation.

A solution to this problem is provided in U.S. patent application Ser. No. 500,864, filed Aug. 27, 1974 now U.S. Pat. No. 3,917,001. The system disclosed in that application includes a circuit for switching the release mechanisms from a series to a parallel arrangement a short period after system activation is initiated. Although a substantial improvement over the prior art, the disclosed system requires a pair of electrical contacts for all but one of the individual release mechanisms employed and can require a plurality of relay windings in systems having a large number of release mechanisms.

The object of this invention, therefore, is to provide a reliable, less costly fire protection system of the type employing a plurality of individual suppressant units all having electrically operated release mechanisms adapted for coincident activation.

SUMMARY OF THE INVENTION

The present invention is a fire protection system including a plurality of suppressor units activatable to suppress a detected fire; a plurality of electrical current responsive activators, one associated with each of said suppressor units and adapted to induce activation thereof; a control circuit connecting the activators in series and including an actuator for initiating activating current flow to the activators; and an auxiliary circuit for connecting the activators parallel in response to the initiation of activating current flow by the actuator, the auxiliary circuit including a plurality of electronic switches, one connected between the supply and each of the junctions between each pair of series connected activators. The electronic switches provide a reliable, low cost circuit arrangement that insures that all functional activators will operate in the event of an abnormal condition even though a single activator fails in such a way as to prevent normal series operation of the system.

In a preferred embodiment of the invention, the supply is a DC supply and the auxiliary circuit includes a first set of diodes, one connected between each alternate junction between the series activators and one terminal of the supply; and a second set of diodes, one connected between each of the other alternate junctions between the activators and another terminal of the supply. Each set of diodes is connected to the supply terminals by relay contacts controlled by a relay winding energized in response to activating current flow. The occurrence of the abnormal condition induces activating current flow which after a slight delay energizes the relay winding and closes the control contacts to connect the diodes between the supply and the activators. The diodes are arranged so as to establish parallel current flow through the activators and thereby insure proper operation of any functional activators not activated during the series operational mode.

In a featured form of the invention, the individual suppressor units comprise vessels filled with a fire suppressing agent that is released by activation of an explosive squib. The actuator is a device that initiates current flow to the series connected activator squibs and can be either a manually operated switch or a condition responsive device such as a thermal switch, or a products of combustion detector.

DESCRIPTION OF THE DRAWING

These and other objects and features of the present invention will become more apparent upon a perusal of the following description taken in conjunction with the accompanying drawing which is a schematic circuit diagram illustrating a preferred embodiment of the invention.

DESCRIPTION OF THE PREFERRED EMBODIMENT

Referring now to the drawing there are shown a plurality of vessels 11 filled with a suitable fire extinguishing agent and distributed strategically throughout a fire protected zone. Associated with each of the vessels 11 is an explosive squib 12, 13, 14, 15 and 16 that is detonated by dectrical current flow to induce release of the agent contained. The vessels 11 and the activators 12 – 16 are conventional and of a type, for example, disclosed in U.S. Pat. Nos. 2,693,240 and 3,523,583. Connecting the activators 12 – 16 in series between positive 17 and negative 18 terminals of a DC power source 19 is a control circuit that includes an actuator switch 21. Although the actuator 21 can be a simple manual switch, it preferably comprises a condition responsive sensor that closes the circuit between the power source 19 and the activators 12 – 16 in response to detection of a given abnormal condition such as fire. Suitable condition responsive sensors include, for example, thermal switches such as disclosed in U.S. Pat. Nos. 2,537,028 and 3,423,585. Connected between the activators 12 – 16 and the power source 19 is a supervisory network including a relay coil 22 that provides a limited supervisory current flow through the activators. Operated by the coil 22 are normally opened contacts 23 connecting a power supply 24 to an indicator lamp 25.

An auxiliary control circuit 31 includes a first set of diodes D1 and D2 connected by a pair of normally open relay contacts K1 to the positive terminal 17 through the actuator switch 21. Each of the diodes D1 and D2 also is connected to a different alternate junction between the actuators. Also included in the auxiliary control circuit is a second set of diodes D3, and D4 connected by a pair of normally open contacts K2 between one of the other alternate junctions between the activators and the negative terminal 18. Controlling the contacts K1 and K2 is a relay coil K connected between the positive and negative terminals 17 and 18 by a delay circuit 32 and the actuator switch 21.

During normal operation, a supervisory current of, for example, 5–10 milliamps flows through the series activators 12 – 16 and the relay 22 maintaining the contacts 23 open and the indicator light 25 de-energized. However, any failure such as an individual activator with an abnormally high resistance that would prevent activating current flow through the series connected activators 12 – 16 also will reduce supervisory current to less than the holding level of the winding 22, allowing the contacts 23 to close the thereby energize the indicator lamp 25. Having observed the energized light 25, maintenance personnel can examine the control circuit and correct the fault to regain system integrity.

In response to an abnormal environmental condition, such as a fire, the closing of the control switch 21, either manually or by a suitable sensor, will initiate activating current flow. The resultant coincidental detonation of all the squib devices 12 – 16 induces release of the suppressant contained by the vessels 11. In addition, when the control switch 21 is closed, the delay 32 is activated. Upon expiration of a predetermined delay period, the relay coil K is energized resulting in the closure of relay contacts K1 and K2. These contact closures transfer the activators 12 – 16 from their initial series connection into a parallel connection provided by the diodes D1 – D4. Thus, the squibs 12 – 16 become independently connected in parallel across the terminals 17 and 18 of the supply 19. For example, current flow through the squib 12 is provided by the diode D3 and the contacts K2; current flow through the squib 13 is provided by the contact K1 the diode D1, the diode D3, and the contacts K2; current flow through squib 14 is provided by contacts K1, the diode D1, the diode D4, and the contacts K2; current flow through squib 15 is provided by the contacts K1, the diode D2, and the diode D4 and the contacts K2; and current flow through the squib 16 is provided by the contacts K1 and the diode D2. If there were a partial or total system failure during the initial series firing of the squibs 12 – 16 due to an open or high resistance squib, then all but the affected squib would be activated after the transfer to parallel connections. Thus, a series activator failure will result in no more than a single failure rather than in a possible total system failure.

Obviously, many modifications and variations of the present invention are possible in light of the above teachings. For example, it will be obvious that the invention can be used with systems having more than the 5 suppressor units illustrated by merely increasing the number of diodes provided in the auxiliary circuit. Although the system requires an odd number of activators, this criteria can be established even in systems having an even number by adding a dummy activator to any series string with an even number of activators. It is therefore to be understood that within the scope of the appended claims, the invention can be practised otherwise than as specifically described.

What is claimed is:

1. An electrical protection system comprising:

a plurality of suppressor units activatable to suppress an abnornal condition;

a plurality of electrical current responsive activators, one associated with each of said suppressor units and adapted to induce activation thereof;

electrical current supply means;

control circuit means connecting said activators in series and comprising actuator means for initiating activating current flow from said supply means to said series connected activators; and auxiliary circuit means comprising switch means for connecting said activators in parallel in response to initiation of activating current flow by said actuator means, said switch means comprising a plurality of electronic switches, one connected between each of the junctions between each pair of said series connected activators and said supply means.

2. A system according to claim 1 wherein said supply means comprises a DC supply and said switches comprise a first set of switches one connected between each alternate junction between said series connected activators and one terminal of said supply means, and a second set of switches one connected between each of the other alternate junctions between said series connected activators and another terminal of said supply means.

3. A system according to claim 2 including first control switch means connected between said one terminal and each switch of said first set, and a second control switch means connected between said other terminal and each switch of said second set.

4. A system according to claim 3 wherein said first and second control switch means comprise relay contacts and a relay winding therefor connected for energization by said activating current flow.

5. A system according to claim 4 wherein said auxiliary circuit means comprises delay means for delaying energizing current flow to said relay winding.

6. A system according to claim 5 wherein said suppressor units comprise vessels containing a fire suppressing agent.

7. A system according to claim 6 wherein said activators comprises explosive squibs for inducing release of said suppressing agent from said vessels.

8. A system according to claim 1 wherein said actuator means comprises a sensor means for detecting said abnormal condition.

9. A system according to claim 8 wherein said supply means comprises a DC supply and said switches comprise a first set of switches one connected between each alternate junction between said series connected activators and one terminal of said supply means, and a second set of switches one connected between each of the other alternate junctions between said series connected activators and another terminal of said supply means.

10. A system according to claim 9 including first control switch means connected between said one terminal and each switch of said first set, and a second control switch means connected between said other terminal and each switch of said second set.

* * * * *